United States Patent [19]

Whitney

[11] 4,291,570

[45] Sep. 29, 1981

[54] STRAIGHTENING APPARATUS FOR VEHICLE BODIES

[76] Inventor: Walter D. Whitney, 1420 Industrial Way, San Carlos, Calif. 94070

[21] Appl. No.: 34,442

[22] Filed: Apr. 30, 1979

[51] Int. Cl.[3] ..... B21D 11/22

[52] U.S. Cl. ..... 72/447; 72/705

[58] Field of Search ..... 414/476, 678; 254/3 R, 254/3 B, 9 R, 9 B; 14/69.5, 71.3, 71.7, 72.5; 72/446, 447, 705; 187/8.41, 8.43, 8.54

[56] References Cited

U.S. PATENT DOCUMENTS

| | | | |
|---|---|---|---|
| 2,522,167 | 9/1950 | Englehart | 72/705 |
| 2,835,400 | 5/1958 | Latzke | 414/476 |
| 3,088,547 | 5/1963 | MacMillan | 187/8.54 |
| 3,626,747 | 12/1971 | Rouis | 72/705 |
| 3,712,108 | 1/1973 | Hunnicutt | 72/705 |

FOREIGN PATENT DOCUMENTS

| | | | |
|---|---|---|---|
| 2507412 | 8/1975 | Fed. Rep. of Germany | 72/705 |

*Primary Examiner*—Lowell A. Larson

[57] ABSTRACT

A horizontally disposed support adapted to support a damaged vehicle and formed so as to facilitate certain pulling and pushing operations on the vehicle body and its frame. The support is provided with an articulated mount at one end to permit said one end to be lowered to a loading position to facilitate placing a vehicle on the support. The articulated mount may then be actuated to raise said one end so that the support is exactly horizontal. The support is also provided with relatively heavy strength members formed to provide longitudinally extending and transversely extending slots in communication with each other thereby forming a passageway permitting an anchor member to be moved to any point on the support to resist relative heavy pulling forces in any desired direction.

5 Claims, 9 Drawing Figures

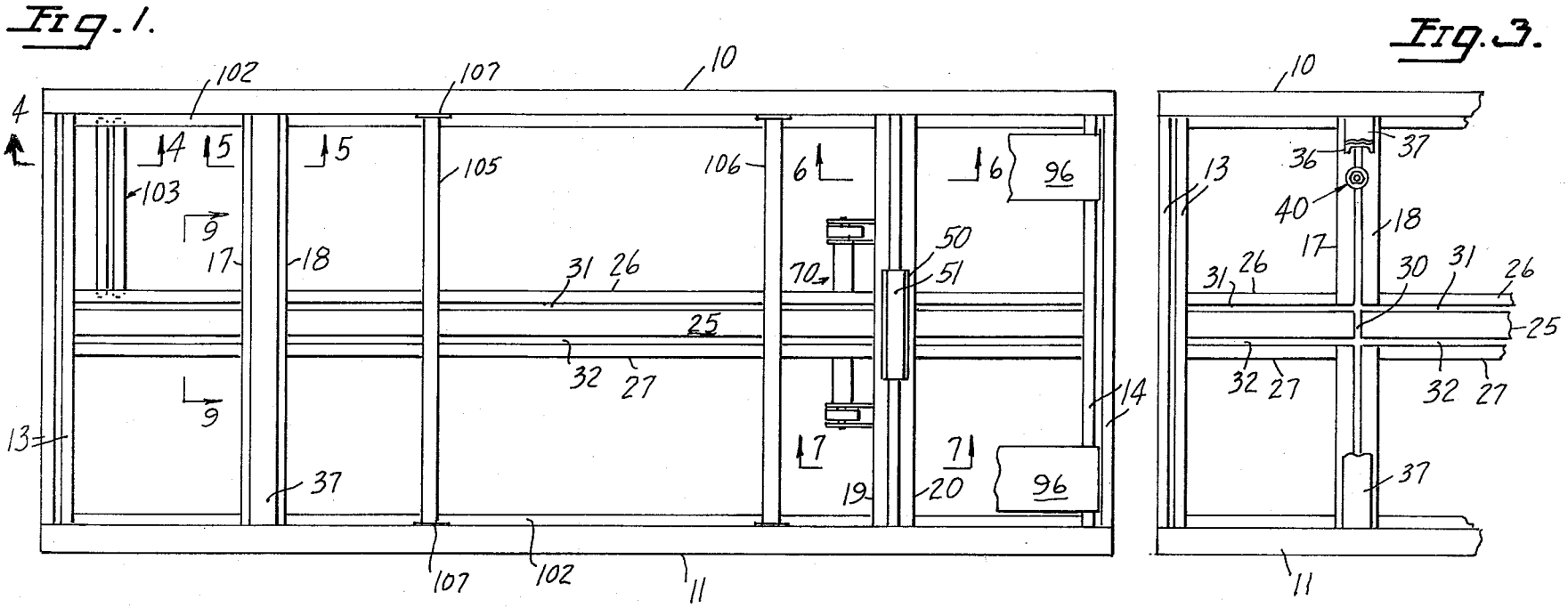
Fig. 3.
Fig. 1.
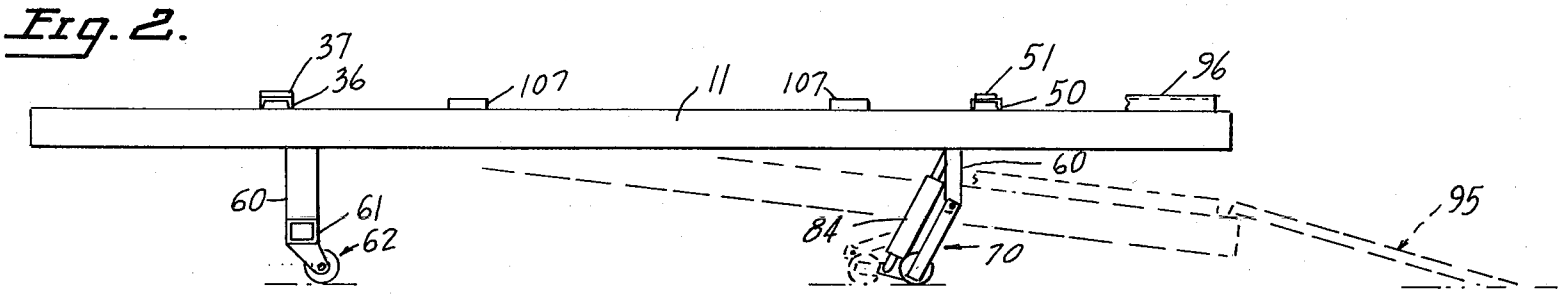
Fig. 2.

STRAIGHTENING APPARATUS FOR VEHICLE BODIES

This invention relates to a frame or support for supporting a damaged vehicle in such a manner as to permit various pushing and pulling operations to be performed on the body and the frame of such vehicle.

The subject matter herein disclosed bears certain similarities to the devices disclosed in U.S. Pat. No. 3,398,565 dated Aug. 27, 1968; U.S. Pat. No. 3,777,541 dated Dec. 11, 1973; and U.S. Pat. No. 3,921,433 dated Nov. 25, 1975. Certain details of construction will be incorporated hereby by reference to said patents.

The main objects of the present invention are to facilitate both the loading of a damaged vehicle on the support and performing certain pushing and pulling operations on the vehicle.

Another object of the invention is the provision of a support of the character described wherein a relatively large support may be provided within a relatively small shop space by permitting the support to be tilted at a favorable angle to facilitate loading and unloading of a damaged vehicle.

Still another object of the invention is the provision of a support of the general type as shown in U.S. Pat. No. 3,777,541 in which the support is formed so as to facilitate the use of an anchor member which improves the versatility of the support by permitting the pushing or pulling member to be oriented at any angle with reference to the vehicle body.

Other objects and advantages will be apparent from the following specification and from the drawings.

FIG. 1 is a top plan view showing the essential elements of the invention.

FIG. 2 is a side elevation of the structure of FIG. 1.

FIG. 3 is a fragmentary top plan view of one end of the structure of FIG. 1 with portions broken away to show the passageways within which the anchor member may be moved.

First with reference to FIGS. 1 and 2 the invention comprises an elongated rectangular frame or support provided along its longitudinally extending side edges with relatively heavy tubular members which may be in the order of 6"×5" tubes having a relatively thick wall. The ends of the support are each formed by a pair of spaced apart tubular members 13 at one end with said members defining a slot therebetween which facilitates the mounting of certain apparatus used with the present invention (see U.S. Pat. No. 3,777,541). The opposite end is formed in a similar manner by spaced apart tubes 14.

Figure 5:
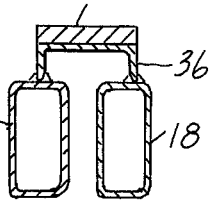
FIG. 5 is a cross section taken in a plane indicated by lines 5—5 of FIG. 1.
Figure 6:
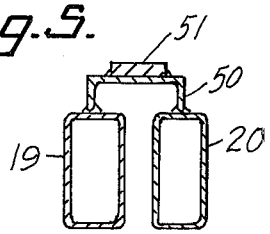
FIG. 6 is a cross section taken in a plane indicated by lines 6—6 of FIG. 1.

At the heavily used end of the support which corresponds to the end at which the front end of the damaged vehicle is supported there are provided a pair of spaced apart relatively heavy tubular members 17, 18 (FIG. 5). These members 17, 18 are welded at their ends to the inner sides of longitudinal side members 10, 11. In a similar manner near the opposite end of the support a pair of tubular members 19, 20 extend transversely across the support and are also welded at their opposite ends to longitudinal members 10, 11 (FIG. 6).

Figure 9:
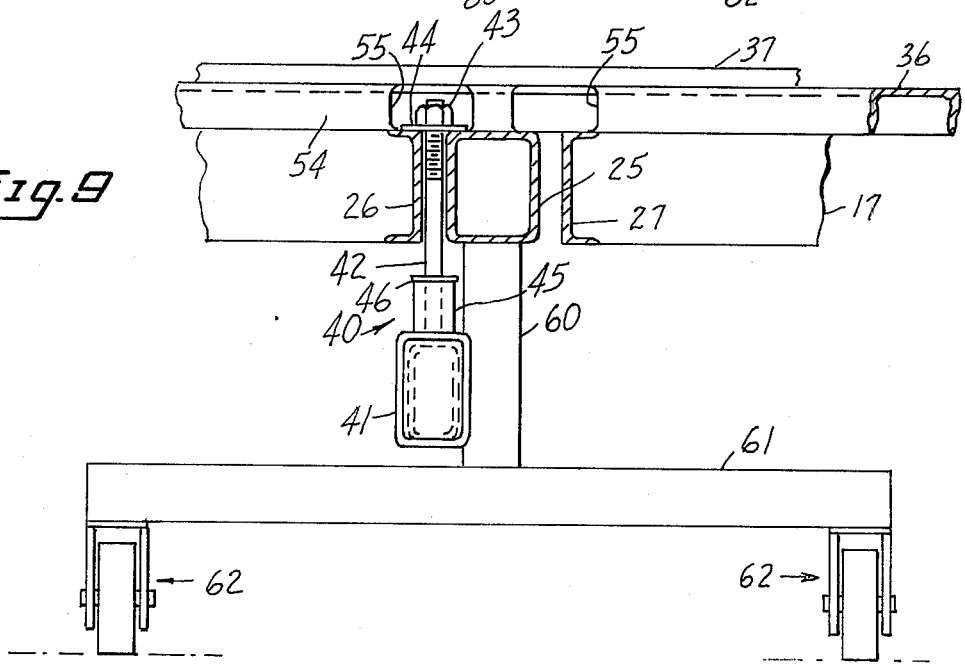
FIG. 9 is a fragmentary transverse view of the second mount taken in a plane indicated by lines 9—9 of FIG. 1.

Along the longitudinal center line of the support there is provided a relatively heavy tubular member 25 and on each of the opposite sides and spaced from member 25 are channels 26, 27 (FIG. 9). At their intersection tubes 17, 18 and 25 and channels 26, 27 are welded together to form an integral unit except that the slots formed between the channels 26, 27 and the longitudinal member 25 and the slots formed between transverse members 17, 18 are permitted to communicate with each other as will now be described.

As best seen in FIG. 3 the channels 26 at the above noted intersection are welded to members 17 and 18 but the longitudinal member 25 is interrupted at said intersection to provide a transversely extending slot 30 which communicates with the slot 31 between channel 26 and longitudinal member 25 and also communicates with slot 32 between channels 27 and central member 25.

The slot 31 in the interrupted member 25 of course weakens the latter and this weakness is compensated for by the structure shown in FIGS. 5 and 9. This compensating structure comprises a downwardly opening channel 36 the legs of which are welded to the members 17, 18 (FIG. 5). This channel 36 preferably extends along the entire length of the members 17, 18 and to provide further stiffness a relatively heavy flat bar 37 may be welded to the upper side of the web of the channel.

The various slots 30, 31, 32 shown in FIG. 3 provide communicating passageways along which an anchor hanger may be moved to various positions as described with reference to the support. This anchor hanger will now be described.

As best seen in FIG. 9 the anchor hanger generally designated 40 comprises a relatively short length 41 of tubular material which is adapted to receive therein the horizontally extending outer end of the L-shaped frame of the type disclosed in U.S. Pat. No. 3,777,541. As disclosed in said patent, the hanger 40 is designated to withstand extremely high vertically downwardly directed forces resulting from the use of the L-frame of the reference patent.

Secured to the top of the sleeve 41 by welding is the lower end of a vertically extending bolt 42 which is adapted to be received in any one of the above noted slots 30, 31, 32. Said bolt 42 is threaded at its upper end to receive a nut 43 which, in cooperation with the heavy washer 44, resists the downward pull on anchor hanger 40.

An extremely important feature of the present invention is the fact that the anchor hanger 40 may be moved longitudinally and transversely about the support to almost any desired location to accommodate the above noted L-frame regardless of the direction in which the L-frame is being employed. As best seen in FIG. 1 the longitudinally extending slots 31, 32 extend to the heavy cross member 19.

The anchor hanger 40 may also include a spacer 45 and a washer 46 so that when the hanger is not under the channel 36 the nut 43 may be tightened to permit the washers 44, 46 to grip the top and bottom surfaces of the channel 26 and 25 seen in FIG. 9.

The arrangement of the communicating slots shown in FIG. 3 is substantially duplicated near the opposite end of the support but in this case since the forces normally applied to the support are much less than at the forward end of the vehicle it is possible in most cases to use a relatively short channel 50 and a relatively lighter flat bar 51. In either event the slot arrangement at both ends of the support is about the same and the channels and flat bars welded to the tops of cross members 17–20 similarly constitute a bridge bridging the gap in the central longitudinal member 25. As best seen in FIG. 9 the flanges 54 of channel 36 are cut away to provide openings 55 to allow the hanger 40 to be moved to almost any location at the forward, or heavy end, of the frame. A similar anchor hanger may be provided for the lighter loaded right-hand end of FIG. 1. The only difference between the two ends of the support is that the slots 31, 32 terminate at the cross piece 19.

The vehicle support is spaced upwardly from ground level by means of a vertically extending leg 60 which is welded at its upper end to longitudinal member 25 and welded at its lower end to a transversely extending member 61 provided at its opposite ends with casters generally designated 62 (FIG. 9).

The mount at the opposite end of the support is generally designated 70 and comprises a pair of downwardly extending legs 71 which are pivotally connected by pins 72 to the upper ends of flat bars 74 with each pair of flat bars 74 integrally connected together by means of a spacer 75 to which said flat bars are welded. The inner flat bars 74 are fixedly secured together by means of an elongated tube 76 and shafts 78 to serve to rotatably support ground wheels 80.

Figure 8:
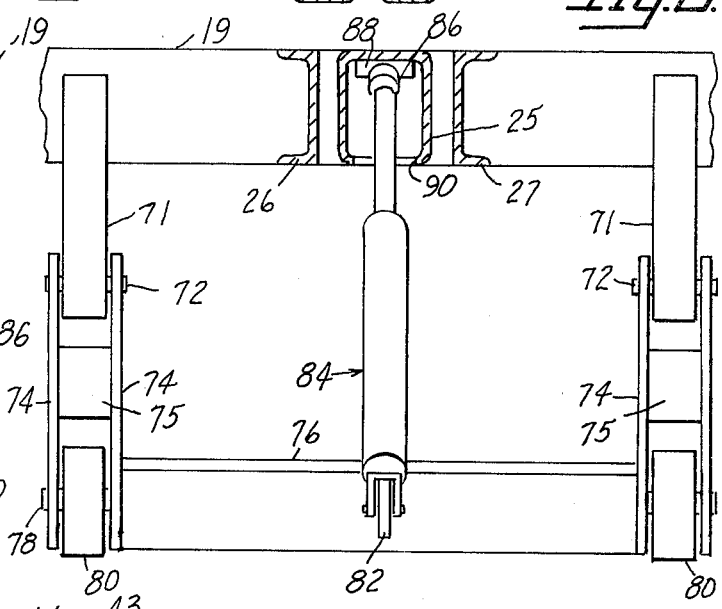
FIG. 8 is a vertical view taken at right angles to FIG. 7.

Intermediate the ends of connecting tube 76 the same is provided with a lug 82 to which is pivotally connected one end of the body of an hydraulic ram generally designated 84. The threaded outer end of the piston at the other end of ram 84 is provided with a pipe cap 86 to which is welded a short length of rod 88. As best seen in FIG. 8 the underside of the central strength member 25 is formed with an opening 90 through which the ram may extend so as to permit the rod 88 to bear against the upper corner between central longitudinally extending member 25 and transverse member 19.

Figure 7:
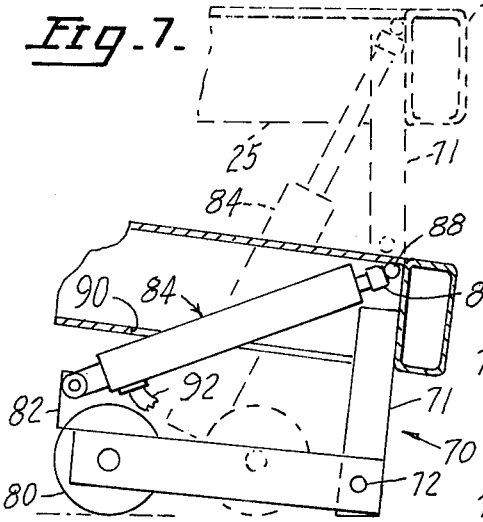
FIG. 7 is a cross section taken in a plane indicated by lines 7—7 of FIG. 1 and showing the articulated mount.

As best seen in FIG. 7 ram 84 may be actuated by means of hydraulic fluid through the conduit 92 so that the support may be swung upwardly from the full line position of FIG. 7 to the dotted line position. In FIG. 8 this structure is shown in full line in its upper position. As best seen in FIG. 2 the support may be swung downwardly at its rear end to the dotted line position by permitting hydraulic fluid to escape through conduit 92 so that the support comes to the full line position of FIG. 7 which is the dotted line position of FIG. 2. In this latter position it will be seen that approach ramps 95 may be connected to the right hand end of the vehicle support so as to permit a damaged vehicle to be pulled or driven onto the vehicle support. Said ramps 95 may register with treads 96, a portion of a pair of such treads being shown in FIGS. 1 and 2, the remainder of the treads being omitted for clarity of the views (see U.S. Pat. No. 3,777,541). It will be apparent that the articulated mount at the right hand end of the structure is important to permit the use of the support in a limited space since the length of the approach ramp 95 may be relatively short when the support is lowered to its dotted line position of FIG. 2.

Figure 4:
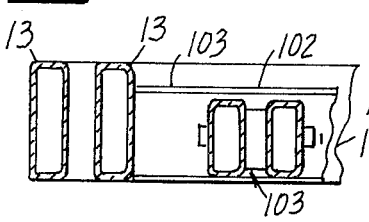
FIG. 4 is a cross section taken in a plane indicated by lines 4—4 of FIG. 1.

Additional parts may be added to the above described structure for performing conventional operations. For example, slides may be provided for receiving tools used in repair operations. To this end channels 102 may be welded to the inner sides of longitudinal members 10, 11 to cooperate with channels 25, 26 for slidably receiving such slides, one of which is indicated at 103 (FIGS. 1, 4).

Also additional cross pieces 105, 106 may extend between and be secured to longitudinals 10, 11 for supporting treads such as those indicated at 96. Flat bars 107 can be added to prevent said treads from falling off the support.

I claim:

1. Apparatus for straightening vehicle bodies and frames comprising:

a generally rectangular vehicle support, said support including a pair of relatively heavy longitudinally extending strength members and a pair of transversely extending strength members, the members of each of said pairs being spaced apart horizontally to define a slot therebetween with said slots in communication with each other at the intersection of said longitudinal and transverse pairs to define a passageway having two runs in intersecting and communicating relationship, and a hanger extending vertically within said passageway and adapted to slide at its upper end on said strength members to any point in said passageway.

2. Apparatus according to claim 1 wherein a bridge structure is provided over said members at said intersection and rigidly secured thereto to compensate for the loss of strength due to said slot.

3. Apparatus according to claim 2 wherein said bridge structure includes an inverted channel secured along each flange to one member of one of said pairs.

4. Apparatus according to claim 3 wherein a flange of said channel is provided with an opening to permit movement of said hanger therethrough.

5. Apparatus according to claim 1 wherein a third strength member is provided with one of said pairs to define two parallel slots.

* * * * *